United States Patent [19]

Lamberton

[11] Patent Number: 4,954,013

[45] Date of Patent: Sep. 4, 1990

[54] MEANS AND METHOD FOR STABILIZING SHORELINES

[75] Inventor: Bruce A. Lamberton, Strongsville, Ohio

[73] Assignee: Jacquelyn Lamberton, Strongsville, Ohio

[21] Appl. No.: 62,132

[22] Filed: Jun. 12, 1987

[51] Int. Cl.[5] ..... E02B 3/06

[52] U.S. Cl. ..... 405/25; 405/30; 405/32

[58] Field of Search ..... 405/15, 16, 19, 21, 405/25, 32, 23, 26, 27, 28, 30, 31, 33, 34, 35

[56] References Cited

U.S. PATENT DOCUMENTS

| | | | |
|---|---|---|---|
| 1,819,305 | 8/1931 | Snyder | 405/32 |
| 1,969,123 | 8/1934 | Doble | 405/32 X |
| 2,068,537 | 1/1937 | Dorn | 405/35 X |
| 2,092,183 | 9/1937 | Rehfeld | 405/19 |
| 3,487,645 | 1/1970 | Frankel | 405/26 |
| 3,670,504 | 6/1972 | Hayes et al. | 405/32 |
| 3,928,701 | 12/1975 | Roehner | 405/30 X |
| 4,341,489 | 7/1982 | Karnas | 405/35 |
| 4,367,977 | 1/1983 | Schaaf et al. | 405/25 |
| 4,388,019 | 6/1983 | Kajihara | 405/25 |
| 4,439,059 | 3/1984 | Kikuzawa et al. | 405/25 |
| 4,465,399 | 8/1984 | Kikuzawa et al. | 405/32 |

*Primary Examiner*—David H. Corbin

*Attorney, Agent, or Firm*—Fay, Sharpe, Beall, Fagan, Minnich & McKee

[57] ABSTRACT

An offshore barrier module which is adapted to retard the wave induced erosion of an adjacent shoreline includes a porous barrier member for retarding the flow of water therepast, to reduce the velocity thereof and to thereby promote the deposition of particulate matter at and adjacent to the barrier member. The barrier member includes an elongated hollow, substantially cylindrical body which has horizontal and vertical elements that extend around the body and are secured to each other. A ballast member is also provided for weighing down the barrier member.

14 Claims, 3 Drawing Sheets

MEANS AND METHOD FOR STABILIZING SHORELINES

BACKGROUND OF THE INVENTION

The present invention relates generally to a means and method for stabilizing shorelines. More specifically, the invention relates to an offshore barrier module and its use for stabilizing an adjacent shoreline.

Waves impinging on a beach dislodge soil particles, i.e. sand, which are then swept seawrd where they can form an underwater ridge of sand parallel to the shoreline. This is known as a long shore bar. In times of heavy wave action, the beach tends to decrete, i.e. lose sand, and the bar tends to accrete. In times of light wave action, however, the movement of sand particles is reversed and the beach tends to accrete at the expense of the bar. This is a natural phenomenon and on most beaches there is a constant exchange of sand between these two features with the direction of transport being dependent on the character of the waves. When the waves are large and follow close upon each other, as they do under storm conditions, the beach is eroded and the bar builds up. When calm conditions return, the small waves rebuild the beach at the expense of the bar.

However, this natural beach stabilizing phenonmenon is not always present because of littoral currents, predominating wind directions, man-made objects which are interposed on the beach or other natural and artificial causes. Various structures have therefore been utilized in an attempt to stabilize beaches.

It has long been known that beaches and shorelines of rivers, lakes, and oceans may be protected or stabilized by placing structures along the shoreline or at some distance offshore under water. The structures can serve to obstruct the flow of sediment carrying water and cause the deposition of at least part of the sediment in the immediate vicinity of the stabilizing structure. Examples of such structures are impermeable groins, permeable groins, artificial seaweed and the like.

Impermeable groins are constructed of sheet piling of steel, concrete, or wood driven in a continuous row generally perpendicular to the shoreline. Sediment will be deposited from water moving transverse to the row of piling in a direction upstream from the structure. Such groins may also be constructed from mounds of stones, concrete blocks, and the like.

Permeable groins are similarly constructed except that the sheet piles are driven at some distance apart permitting sediment carrying water to pass through the structure between the sheets but so reducing the velocity of the water which passes through that heavier particles of sediment will be deposited downstream from the structure. Such structures are constructed by securing vertical boards at some distance apart on a frame and positioning the frame transverse to the flow of sediment carrying water where it is secured by piles driven into the ground.

Another type of stabilizing structure is artificial seaweed. It has been discovered that naturally growing seaweed tends to trap water-borne sediments by reducing the water velocity to the point that sediment deposition occurs. This effect is duplicated by artificially assembling clusters of low density synthetic tapes or filaments and securing the clusters to the seabottom by a weighting means such as sandbags to form an array of some area in extent similar to a large bed of naturally growing seaweed. Such arrays have been used to protect the legs of offshore oil drilling platforms from erosion of the surrounding soil. Synthetic filaments have been produced from air blown polypropylene to produce filaments of maximum buoyancy.

However, all of the aforementioned types of barrier structures have their problems. Impermeable groins are extremely expensive to construct and obstruct the full utilization of the water adjacent the shore by small boat traffic and individuals. Also, for construction purposes, access to the site is required by heavy equipment. Soil decretion downstream or downdrift of such groins is pronounced and is detrimental to the owners of adjacent property.

Permeable groins present all of the problems mentioned with regard to impermeable groins except that they cause a downdrift accretion of sediment and so may actually benefit the owners of downdrift property. However, permeable groins are ineffectual in preventing a littoral movement of soil particles dislodged by wave action unless they extend so far seaward from the shoreline as to be impossibly expensive. Thus, permeable groins are used effectively only to control the movement of soil parallel to the shoreline caused by longshore currents as in a river or along a shoreline where there is a pronounced littoral sediment carrying current.

Artificial seaweed has been successfully used at substantial depths of water to trap current borne sediment. However, it has not been effective in preventing the movement of sediment along shorelines. This is so because the high velocity and turbulence of water near a shore due to the breaking of waves causes the synthetic filaments to assume a position nearly parallel to the flow of water and so the water-borne sediments easily pass over the filaments with a minimal reduction in water velocity. Also, the plastic from which the filaments are constructed apparently suffers a loss of buoyancy with the passage of time which then renders the filaments ineffective to trap sediment.

Another known apparatus for prevention of shore erosion involves the use of modules including a plurality of spaced wooden boards secured to belts which are anchored to a concrete base. This assembly is said to cause sand to be deposited from de-energized waves. However, the modules are not commercially acceptable because the floating wooden boards are objectionable to bathers and others who wish to use the adjacent shoreline. Since the wooden boards are rigid, bathers can be struck and injured by them as the boards are moved by the action of waves in the body of water.

Accordingly, it has been considered desirable to develop a new and improved means and method for stabilizing shorelines which would overcome the foregoing difficulties and others while providing better and more advantageous overall results.

BRIEF SUMMARY OF THE INVENTION

In accordance with the present invention, an offshore barrier module adapted to retard the wave induced erosion of an adjacent shoreline is provided.

The prior art barrier structures are attempting to protect beaches from the damage caused not only by normal wave action but also by major storms. It is doubtful that this can be done economically. Such storms tear up a beach and carry the soil or sand out to sea far beyond the normal offshore sandbars thereby permanently eroding the beach.

While it is doubtful that barrier structures can prevent storms from tearing up a beach in the first place, the barrier module of the present invention is so designed that it can catch some of the beach soil before it is washed out to sea. The soil or sand so caught can be caused to accumulate in an artifically created offshore sandbar. Subsequently, during mild weather low water waves will wash this sand back up onto the beach where it can again be sacrificed to the next major storm.

More particularly in accordance with the invention, the barrier module includes a porous barrier means for retarding the flow of water therepast to reduce the velocity thereof and to thereby promote the deposition of particulate matter at and adjacent to the barrier means. The barrier means comprises an elongated hollow substantially cylindrical body which includes horizontal and vertical elements that extend around the body and are secured to each other. A ballast means is provided for weighing down the barrier means.

According to another aspect of the invention, the horizontal elements comprise a plurality of spaced apart elongated slats and the vertical elements comprise at least two spaced apart hooplike straps to which the slats are secured.

According to still another aspect of the invention, the slats are unevenly spaced on the periphery of the cylinder such that approximately 75% of the periphery near the top of the cylinder, above the center line thereof, is open area but only approximately 25% of the periphery near the base of the cylinder, below the center line thereof, is open area.

According to yet another aspect of the invention, the slats and straps are fabricated from a plastic material having a relatively high modulus of elasticity.

According to still another aspect of the invention, the cylindrical body is comprised of a three dimensional mesh material.

According to yet still another aspect of the invention, the barrier module further comprises a barrier member located within the porous barrier means. Preferably, the barrier member comprises a diaphragm extending along a longitudinal centerline of the bore of the porous barrier means.

In accordance with a further aspect of the invention, the barrier module further comprises a cylindrical body located within the barrier means. The body is comprised of a three dimensional mesh material and has a smaller diameter than the barrier means to allow the body to reciprocate within the barrier means as waves and currents dictate.

In accordance with a still further aspect of the invention, the ballast means includes at least one anchor member secured to the barrier means.

In accordance with a yet further aspect of the invention, the barrier means comprises an elongated hollow substantially cylindrical body which is flexible so that the force of waves transverse to the axis of the body can deform the body.

In accordance with still yet another aspect of the invention, an offshore barrier array is provided. The barrier array is adapted to retard the wave induced erosion of an adjacent shoreline and comprises a plurality of barrier modules.

One advantage of the present invention is the provision of a means for beach stabilization which does not try to protect the beach from the damage caused by a severe storm but rather catches some of the soil or sand that would normally be washed out to sea by such a storm. This sand is caused to accumulate in an artifically created sandbar offshore. The sand from this sandbar can then be washed back to shore during milder weather by normal wave action.

Another advantage of the present invention is the provision of a means for stabilizing beaches which presents no obstruction to shoreline utilization and enjoyment and will benefit rather than damage the owners of adjacent property.

Still another advantage of the present invention is the provision of a means for stabilizing beaches which is very economical to construct and does not require the access of heavy equipment to a shoreline to construct or deploy the structure, and is equally effective in controlling wave dislodged sediment and current formed sediment.

Yet another advantage of the present invention is the provision of a means for stabilizing beaches which can be as easily and economically installed at great distances from the shoreline as along the shoreline itself and can be used either in shallow water or at great depths of water.

A further advantage of the present invention is the provision of a means for stabilizing beaches which is comprised of an elongated hollow substantially cylindrical body made of a flexible material so that the force of waves transverse to the axis of the body can deform the body and so that an object striking the body can also deform the body thereby preventing damage to objects striking the body.

Yet still another advantage of the present invention is the provision of a means for stabilizing beaches which does not depend upon the buoyancy of a barrier structure for entrapment of water-borne sediment and is capable of functioning at both low wave speeds and high wave speeds and in the presence of turbulent water to trap water-borne sediment.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts, preferred embodiments of which will be described in detail in this specification and illustrated in the accompanying drawings which form a part hereof and wherein.

DETAILED DESCRIPTION OF THE PREFERRED EMBODIMENTS

Figure 1:
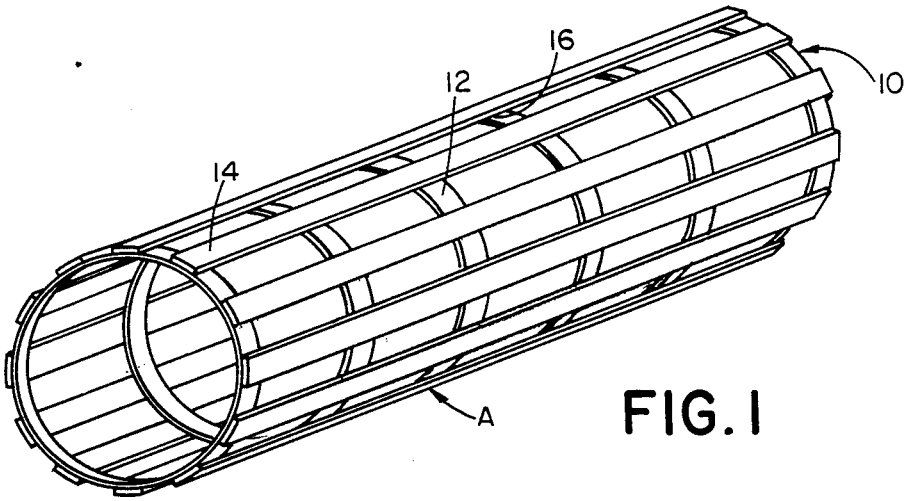
FIG. 1 is a perspective view of a first preferred embodiment of a means for stabilizing shorelines according to the present invention.

Referring now to the drawings, wherein the showings are for the purpose of illustrating the preferred embodiments of the invention only and not for purposes of limiting same, FIG. 1 shows the subject new means for stabilizing beaches in the form of a module A. The module includes a cylindrical body 10 that is comprised of a plurality of axially spaced apart hoop members 12 and a plurality of radially spaced apart slat members 14.

The hoops and slats are so connected at their points of intersection as to resist rotation of the assembly in a direction parallel to the axis of the module. The points of intersection of the hoops 12 and slats 14 can be secured by sonic welding, or the like, at respective weld joints 16.

The material of which the hoops and slats are constructed may be a plastic material with a relatively high modulus of elasticity such as polyester or polypropylene. Such material is often used in package strapping and one commercial producer of such strapping material is the Signode Corporation of Chicago, Illinois. One material contemplated for this application is a strapping material which is on the order of approximately two inches wide and which has a thickness of approximately 0.030 inches. The modulus of elasticity of the material can be on the order of 1 million psi and the tensile strength can be on the order of 60,000 psi.

The plastic material from which the module is constructed can be carbon loaded to reduce it's structural degradation due to its exposure to water, ozone, ultraviolet radiation, and other strength degrading substances and conditions. The plastic material is preferably flexible and not buoyant. It should, however, be appreciated that the body can be made from any other suitable type of material, which does not necessarily have to be plastic, and may be buoyant if desired. However, the material is advantageously flexible or resilient since this will prevent in jury to bathers who might strike the body 10 while swimming or wading.

The body 10 can be anywhere from 12–18 inches in diameter and can be approximately six feet long.

Figure 2:
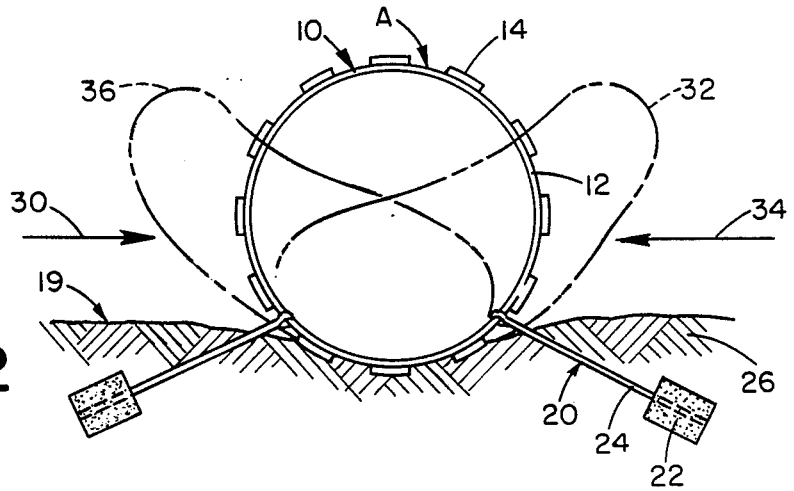
FIG. 2 is an end elevational view of the stabilizing means of FIG. 1 together with a ballast means for securing the stabilizing means in relation to a sea bottom.

With reference now also to FIG. 2, preferably the module A is held in a predetermined position at a sea bottom 19 by a ballast means 20. The ballast means can comprise a block 22 and a cable 24 which is secured at one end to the cylinder body 10 and at the other end in the block 22. Over the course of time, the block 22 may become embedded in the sand 26 at the sea bottom 19 or it may originally be embedded in the sand if desired.

As an onshore wave 30 strikes the module A, it will be deflected toward the shore as at 32 since the module is made of a flexible material. As an offshore wave 34 strikes the module, it will deflect as at 36 in response thereto. When the wave action is dissipated, the module will preferably return to its original substantially cylindrical upright position as illustrated in solid lines in FIG. 2 due to the tensile stresses induced in the preferably resilient hoops 12 thereof when they are bent into a circle.

Figure 3:
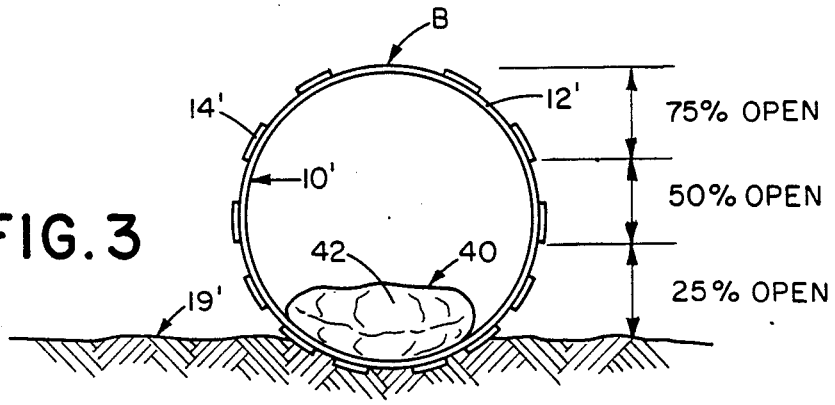
FIG. 3 is a side elevational view of a second preferred embodiment of a means for stabilizing shorelines according to the present invention.

In FIGS. 1 and 2, the slats attached to the circular hoops are uniformly spaced around the circumference of the hoops. Alternatively, it would also be conceivable to have a non-uniformly spaced series of slats as is illustrated in FIG. 3. For ease of illustration and appreciation of this modified construction, like components are identified by like numerals with a primed suffix (′) and new components are identified by new numerals.

In FIG. 3, a module B is shown as having a body 10′ comprising plurality of hoop members 12′, only one of which can be seen in the end elevational view of FIG. 3, as well as a plurality of spaced slats 14′. In this embodiment, however, the slats are more closely spaced toward each other near the bottom of the module and spaced further apart near the top of the module. One desirable such spacing can provide approximatey 75% open area near the top of the module, approximately 50% open area near the longitudinal centerline of the module, and approximately 25% open area near the bottom of the module. A 50% open area can be achieved, approximately, by spacing a two inch wide slat 14′ on a four inch center assuming that the circular hoops 12′ present a small face toward the movement of water. The hoops can, in this embodiment, be approximately 2 inch wide bands that are spaced apart on 18 inch centers.

Such variable spacing of the slats around the hoops might be desirable when the volume of sediment transported is much heavier near the sea bottom than it is at some short distance thereabove. This condition is typical of sand washed offshore by impinging waves. In this type of an application, uniformly spaced slats on a barrier module would simply present an unnecessary obstruction to the movement of water without materially improving sediment entrapment. Also in this embodiment, a different ballast means 40 for the module B is disclosed. More specifically, the ballast means 40 includes a bag 42 which can be filled with a suitable particulate material such as sand or the like. The ballast means can be placed inside the body 10′ to weigh it down and prevent movement thereof by waves. Of course, a plurality of ballast means can be provided if desired.

Figure 4:
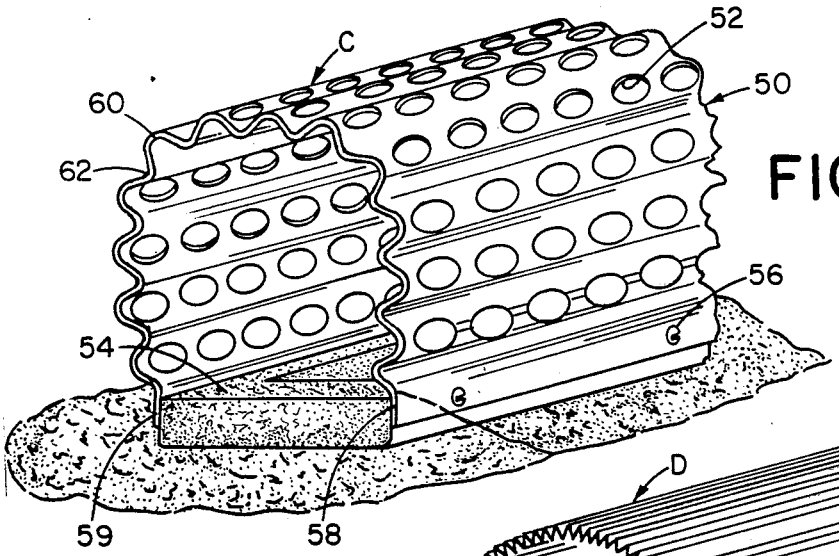
FIG. 4 is a perspective view of a third preferred embodiment of a means for stabilizing shorelines according to the present invention.

A third type of module C is shown in FIG. 4. For ease of illustration and appreciation of this embodiment, like components are identified by like numerals with a double primed (″) suffix, and new components are identified by new numerals.

In this embodiment, the hoop and slat construction disclosed in FIGS. 1–3 is replaced by a U-shaped body 50 made of a flexible or resilient material. A substantial number of apertures 52 are provided in the body to allow water to flow therethrough as urged by waves or currents. A base 54 is provided for the U-shaped body and a plurality of fasteners 56 secure the lateral ends 58, 59 of the body to the base. The base 54 can also serve as the anchor means for holding the body 50 in place on the sea bottom if desired by being made from a heavy material such as concrete, as illustrated. Alternatively, a separate anchor means could be provided for the body 50.

The body 50 can be made of suitable elastically deformable conventional plastic sheet material which has been provided with apertures 52 in suitable number to allow an appropriate percentage of open area as required by the site at which the barrier module will be used.

In order to give the body some rigidity, it can be provided with longitudinally extending ribs 60 separated by grooves 62. Alternatively, the sheet of plastic does not have to be corrugated if that is not required.

The corrugations are, however, advantageous in order to allow the sheet of barrier material to flex more easily in response to wave or current action. The amount of flexure required is a function of site conditions and can be controlled by the varying the heighth and width of the U-shaped body as well as the thickness and elasticity of the sheet material and the depth of the corrugations.

Figure 5:
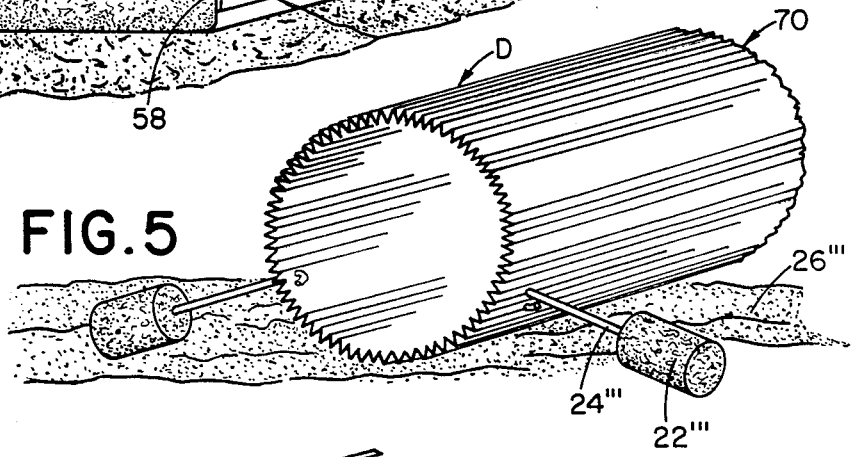
FIG. 5 is a perspective view of a fourth preferred embodiment of a means for stabilizing shorelines according to the present invention.

A yet fourth type of barrier module D is illustrated in FIG. 5. For ease of appreciation of this alternate embodiment, like components are identified by like numerals with a triple primed suffix (''') and new components are identified by new numerals.

In this embodiment, the barrier module D is comprised of a cylindrical body 70 which is made out of a mesh material. One suitable such material is formed of randomly oriented monofilaments of carbon loaded nylon and is produced under the tradename of "Enkamat" by the BASF Corporation. This material is a three dimensional non-woven fabric-like material with a thickness of approximately $\frac{3}{8}$ to $\frac{3}{4}$ inches. The material is elastically deformable and can be rolled into a cylinder and secured in this configuration by conventional means.

In general, the barrier module according to the present invention need not be constructed of hoops and slats or of sheet material but can be formed of any material with requisite structural properties and porosity. For example, one embodiment which can be visualized would be a barrier module constructed of several layers of plastic gridwork laced together to provide the requisite structural and hydraulic properties. All such materials are to be encompassed hereunder and are defined by the generic term "mesh".

In this embodiment, the ballast means comprises concrete blocks 22''' which are secured by cables 24''' to the cylindrical body 70. The concrete blocks 22''' can rest in the sand 26''' on the sea bottom.

The cable 24''' can be a non-corroding tension resisting member such as revetment cable constructed of parallel strands of polyester fiber or the like within a woven or extruded sheath.

Figure 6:
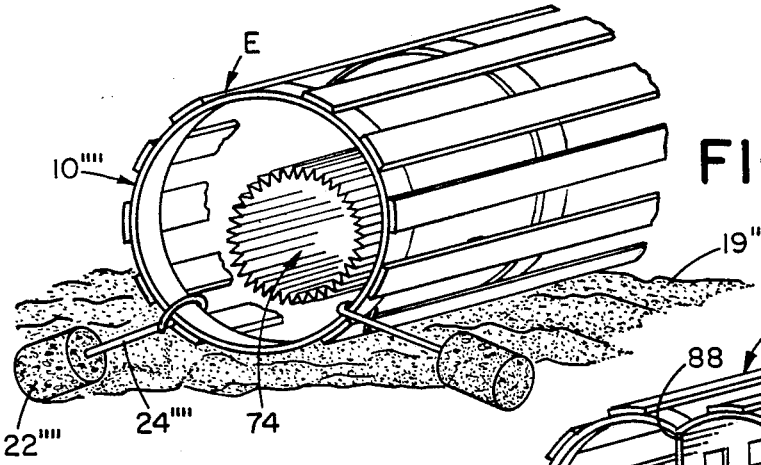
FIG. 6 is a perspective view of a fifth preferred embodiment of a means for stabilizing shorelines according to the present invention.

Yet another type of barrier module E is illustrated in FIG. 6. For ease of appreciation of this embodiment, like components are identified by like numerals with a quadruple primed suffix (''''').

In this FIGURE, the barrier module E comprises a cylindrical body 10'''' which encloses a cylindrical body 74 of mesh material of a smaller diameter than the body 10''''. The body 74 can be called a "valve" or a "filter member." The advantage of positioning a so-called filter member within the body 10'''' is that the filter member can be useful in enhancing the performance of the device by further attenuating the velocity of water moving therethrough. The smaller barrier member 74 can be free to move about within the larger cylindrical body 10'''' as dictated by waves and currents. However, the smaller diameter body 74 could also be tethered by any conventional means within the larger body 10'''' to limit the extent of its movement if that were considered desirable.

To secure the body 10'''' in place on a sea bottom 19'''', a ballast means comprising block members 22'''' and cable members 24'''' is provided.

Figure 7:
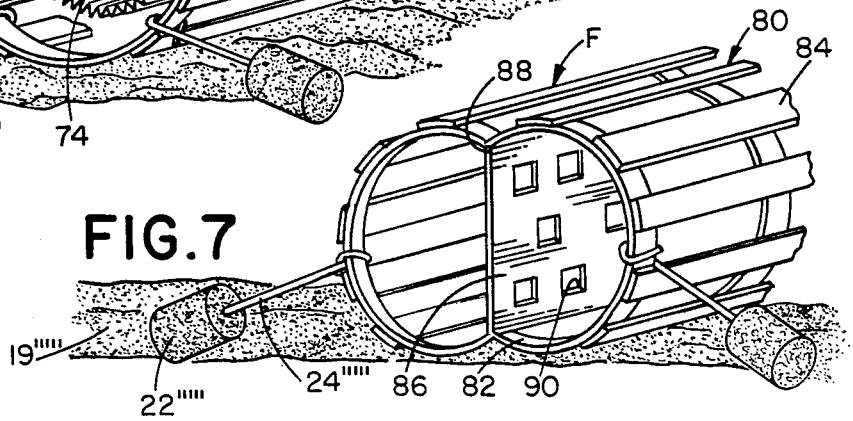
FIG. 7 is a perspective view of a sixth preferred embodiment of a means for stabilizing shorelines according to the present invention.

With reference now to FIG. 7, yet another barrier module F is illustrated therein. For ease of appreciation and understanding of this embodiment, like components are identified by like numerals with a quintuple primed suffix (''''') and new components are identified by new numerals.

This module configuration F includes a body 80 comprising a plurality of spaced hoops 82 and spaced slats 84. A planar barrier member 86 is positioned within the body 80 and is secured therein by a suitable conventional securing means 88 such as welding. A plurality of suitably configured spaced apart apertures 90 is provided in the barrier 86 to allow water to flow therethrough. The advantage of positioning such a barrier within the module is to enhance the performance of the module as a sand trap by interposing additional velocity attenuating material within the area of moving water. Additionally, the barrier 86 can also deform the module to some extent by modifying a resilient otherwise substantially cylindrical shape. The diaphragm or barrier 86 is placed under a light tension by the tendency of the hoops 82 to maintain a substantially circular configuration.

Although only one barrier or diaphragm 86 is illustrated in FIG. 7, it should be appreciated that more than one diaphragm can be placed within the module to enhance its performance. A ballast means comprising block members 22'''' and cable members 24'''' secures the module F in place on a sea bottom 19''''.

Figure 8:
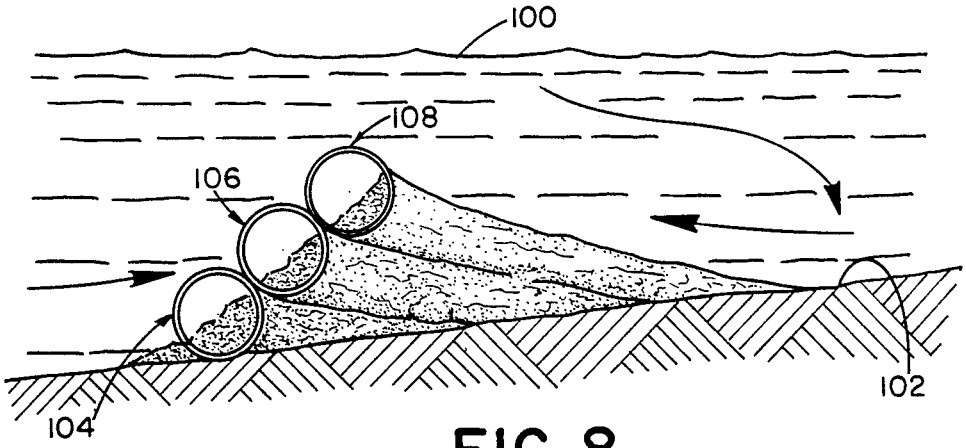
FIG. 8 is an end elevational view in reduced size of a process of sand accumulation and positioning of a plurality of stabilizing means according to the present invention over a period of time.

With reference now FIG. 8, a sea bottom adjacent a shoreline is there illustrated in schematic form. When beach stabilizing soil movement does not take place naturally or when protection from severe storms is desired, beach stabilizing soil movement can be encouraged and stimulated by the placement of the barrier modules described hereinabove, some distance offshore, in a relatively shallow depth of water. The distance from the shoreline and the water depth will depend on site conditions in each case. The depth can be on the order of approximately 3 feet, if desired. In one particular embodiment, it could be imagined that the modules would be placed approximately 1000 feet offshore, parallel to the shoreline in a three foot depth of water.

As the offshore currents in water 100 wash sand away from a beach (not visible in FIG. 8), some of the sand accumulates on a sea bottom 102 inside and behind a first module 104. In such a configuration, there would be a two foot depth of water above the preferably twelve inch diameter first barrier module. This would permit waves up to two feet in height to pass over the module 104 without breaking. Such waves would then break on the shoreline, dislodging soil particles which would be swept away from the beach by the returning wave and which would be deposited in the vicinity of the barrier module 104. At least some of this deposited soil would remain in place between the seasons. Therefore, additional modules 106, 108 could be placed in successive seasons behind and somewhat above the first module as is illustrated to further accumulate a supply of offshore soil and thereby promote beach stability.

Figure 9:
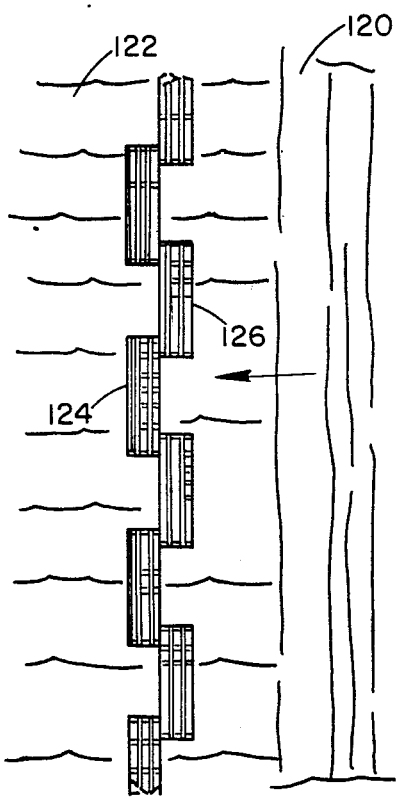
FIG. 9 is a reduced top plan view of a plurality of stabilizing means according to the present invention positioned in a staggered row generally parallel to a shoreline; and, FIG. 10 is a reduced top plan view of a plurality of stabilizing means according to the present invention arrayed in a staggered overlapping pattern generally transverse to the shoreline.

With reference now to FIG. 9, a means for stabilizing shorelines can be positioned adjacent a beach 120 in water 122 as shown. In this embodiment, modules 124, 126 are placed in a staggered row substantially parallel to the shoreline as is illustrated. This placement would constitute an impermeable groin-type placement. But since the modules of the present invention are permeable, the resultant means for stabilizing would be permeable.

Figure 10:
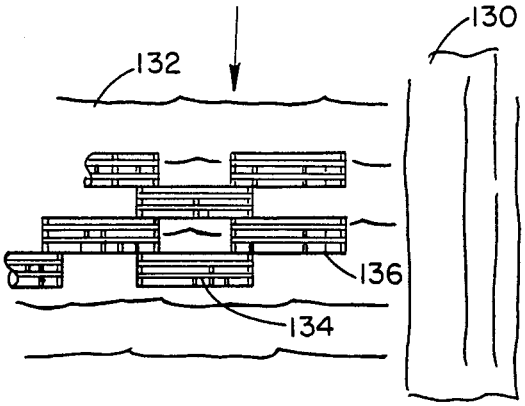

Alternatively, the modules can be arranged in a staggered overlapping pattern generally transverse to a beach 130 in water 132 as is illustrated in FIG. 10. In this FIGURE, the water 132 adjacent the beach 130 holds a plurality of staggered modules 134, 136 in several rows. In this embodiment, while each row of the modules is positioned in a permeable groin-type arrangement, the overall configuration again corresponds to an impermeable groin-type structure. However, since the modules are themselves permeable, the resultant means is also permeable.

One advantage of placing modules in spaced rows is that further attenuation of water velocity takes place at the second row of modules thereby trapping more sand or soil particles thereat.

Although the invention has been shown and described with respect to several preferred embodiments, modifications and alterations thereof will occur to others upon a reading and understanding of this specification. It is intended to include all such modifications and alterations insofar as they come within the scope of the appended claims or the equivalents thereof.

Having thus described the preferred embodiments, the invention is now claimed to be:

1. An offshore barrier module adapted to retard the wave-induced erosion of an adjacent shoreline comprising:

a porous barrier means for retarding the flow of water therepast to reduce the velocity thereof and to thereby promote the deposition of particulate matter at and adjacent to said barrier means, said barrier means comprising an elongated hollow substantially cylindrical body which includes flexible horizontal and vertical elements that extend around the periphery of said body and are secured to each other, and wherein said horizontal elements comprise a plurality of spaced apart elongated slats and said vertical elements comprise at least two spaced apart hoop-like straps to which said slats are secured, said slats extending substantially around a periphery of said straps and wherein said body is flexible so that the force of waves transverse to the axis of said body can deform said body and so that objects striking said body can deform said body; and, a ballast means for weighing down said barrier means.

2. The barrier module of claim 1 wherein said slats are unevenly spaced on the periphery of said cylinder such that approximatey 75% of the periphery near the top of the cylinder above the centerline thereof is open area but only approximately 25% of the periphery near the base of the cylinder below the centerline thereof is open area.

3. The barrier module of claim 1 wherein said slats and said straps are fabricated from a plastic material having a relatively high modulus of elasticity.

4. The barrier module of claim 3 wherein said slats and straps are fabricated from a plastic material having a modulus of elasticity on the order of 1,000,000 psi and a tensile strength on the order of 60,000 psi.

5. The barrier module of claim 1 wherein said ballast means includes at least one anchor member secured to said barrier means.

6. An offshore barrier array adapted to retard the wave-induced erosion of an adjacent shoreline, comprising a plurality of the barrier modules of claim 1.

7. The barrier module of claim 1 wherein said horizontal and vertical elements are made from a non-corroding material.

8. The barrier module of claim 1 wherein said horizontal and vertical elements are made from a material which is resistant to structural degradation caused by exposure to water, ozone and ultraviolet radiation.

9. The barrier module of claim 1 wherein said slats and straps are non-buoyant.

10. An offshore barrier module adapted to retard the wave-induced erosion of an adjacent shoreline, comprising:

a porous elongated hollow substantially cylindrical body comprising:

a plurality of spaced apart elongated longitudinally extending slats, and at least two spaced apart hoop-like straps to which all of said plurality of slats are secured, and wherein said slats and straps are made of a flexible non-corroding material so that the force of waves transverse to the axis of said body can readily deform said body and so that the body does not serve as an obstacle to bathers; and, a ballast means for weighing down said barrier means.

11. The barrier module of claim 10 wherein said slats are evenly spaced apart on said body and extend substantially around the periphery of said body.

12. The barrier module of claim 10 wherein said slats are unevenly spaced apart on said body such that approximately 75% of the periphery above a horizontal plane extending through the longitudinal axis of said body is open area and approximately 25% of the periphery of said body below said horizontal plane is open area.

13. The barrier module of claim 10 wherein said slats and straps are fabricated from a plastic material having a modulus of elasticity on the order of 1,000,000 psi and a tensile strength on the order of 60,000 psi.

14. The barrier module of claim 10 wherein said slats and straps are non-buoyant.

* * * * *